US005609507A

United States Patent [19]

Spector

[11] Patent Number: 5,609,507

[45] **Date of Patent: *Mar. 11, 1997**

[54] PISTOL AND TOY DRAGON FIGURE ASSEMBLY

[76] Inventor: Donald Spector, 380 Mountain Rd., Union City, N.J. 07080

[ * ] Notice: The term of this patent shall not extend beyond the expiration date of Pat. No. 5,564,961.

[21] Appl. No.: 554,258

[22] Filed: Nov. 6, 1995

Related U.S. Application Data

[63] Continuation-in-part of Ser. No. 554,259, Nov. 6, 1995, which is a continuation-in-part of Ser. No. 431,834, May 1, 1995, Pat. No. 5,564,961.

[51] Int. Cl.[6] ..... A63H 3/00; A63H 33/30; A63H 5/04

[52] U.S. Cl. ..... 446/72; 446/405; 446/473; 446/475; 446/485; 222/78; 222/79

[58] Field of Search ..... 446/71, 72, 74, 446/22, 23, 267, 268, 330, 327, 329, 405, 473, 475, 483, 485; 222/78, 79; 239/211

[56] References Cited

U.S. PATENT DOCUMENTS

| | | | |
|---|---|---|---|
| 1,660,085 | 2/1928 | Elnain | 446/74 X |
| 3,299,891 | 1/1967 | Smeton | 446/74 X |
| 4,654,018 | 3/1987 | Farrington et al. | 446/330 X |
| 4,718,877 | 1/1988 | Girsch et al. | 446/330 X |
| 5,167,562 | 12/1992 | Axtell | 446/330 X |
| 5,259,807 | 11/1993 | Crow | 446/473 X |
| 5,301,836 | 4/1994 | Luu | 222/78 |

*Primary Examiner*—Sam Rimell
*Assistant Examiner*—D. Neal Muir
*Attorney, Agent, or Firm*—Michael Ebert

[57] ABSTRACT

A pistol and toy dragon figure assembly in which a pistol concealed in the figure is operable to cause the dragon to appear to be breathing fire and to be emiting roaring sounds. The pistol includes a barrel and a hand grip provided with a trigger. Housed in the pistol is a battery-operated electronic unit which is switched on when the trigger is pulled, the unit having a flashing light generator optically coupled to the barrel and an integrated circuit in which roaring sounds are digitally stored and converted into analog signals which are fed to a miniature speaker. The body of the dragon has an open cavity therein to receive the pistol, the barrel of which is socketed in the head of the dragon in line with its open jaws. When a player grasps the hand grip of the pistol, he then appears to be holding the dragon, and when the player pulls the trigger, red light flashes simulating fire are then emitted from the jaws of the dragon, the fire being accompanied by roaring sounds.

6 Claims, 2 Drawing Sheets

PISTOL AND TOY DRAGON FIGURE ASSEMBLY

RELATED APPLICATION

This application is a continuation-in-part of my copending application Ser. No. 08/554,259, filed Nov. 6, 1995, entitled "WATER PISTOL AND ANIMAL FIGURE ASSEMBLY" which in turn is a continuation-in-part of my copending application Ser. No. 08/431,834, filed May 1, 1995, now U.S. Pat. No. 5,564,961 entitled "WATER-PISTOL AND PUPPET ASSEMBLY" whose entire disclosures are incorporated herein by reference.

BACKGROUND OF INVENTION

1. Field of Invention

This invention relates generally to a pistol and animal figure assembly, and more particularly to an assembly in which the animal figure is that of a dragon who when the pistol is operated then appears to be breathing fire and to be emitting roaring sounds.

2. Status of Prior Art

My above-identified patent application Ser. No. 08/554,259 discloses a water-pistol and stuffed animal figure in which a pistol concealed in the figure is operable to cause water to spit out of the mouth of the figure. The pistol includes a hand grip provided with a trigger, a water reservoir in the form of a cartridge clip insertable in the grip, and a pump which draws water from the reservoir and pumps it into the barrel of the pistol from whose nozzle the water is ejected when the trigger is pulled.

The animal figure which is a replica of a hippopotamus includes a head having an open mouth and a body having an internal cavity which is open at its underside and communicates with the head. The pistol is received within the cavity, its barrel being socketed in the head of the figure and its nozzle aligned with the open mouth whereby when a player grasps the grip with his hand he then appears to be holding the figure, and when he pulls the trigger, water is ejected from the mouth of the figure who then appears to be spitting.

In the present invention, a pistol is concealed in the body of a dragon-like figure, and when the pistol is actuated, the dragon then appears to be breathing fire and at the same time produces roaring sounds, thereby simulating the reputed activity of a real dragon.

A dragon is a mythical creature whose physical characteristics depend on legendary beliefs. For centuries, dragons have existed in the folklore of many peoples, usually being represented as a huge, winged reptile. But in other legends the dragon's physical form is a combination of various animals. However, common to all legendary dragons is that these beasts breathe fire and emit frightful roaring sounds.

There exists a certain ambivalence about the moral character of a dragon, for while in many legends the dragon is an evil creature and an agent of Satan, in others the dragon is a guardian of treasure and a protector of innocent maidens. And in China the dragon is associated with fertility and prosperity. No Chinese New Year celebration parade is complete unless accompanied by a simulated dragon.

While our modern age is perhaps more sophisticated than the medieval period when the status of a hero was determined by his ability to slay an evil dragon, children today remain fascinated with dragons and often play with toy replicas of this mythical beast.

But what these toy replicas lack is a true simulation of a fire breathing and roaring dragon; hence the child has a sense of inadequacy. To give a simple analogy, a baby doll whose eyes are fixedly socketed in the head of the doll is not nearly as pleasing to a child as a doll whose eyes shift realistically as the doll is manipulated. Even more pleasing to a child is a baby doll which can be bottle fed and is capable of urinating.

Inasmuch as a toy dragon figure in accordance with the invention has incorporated therein a pistol which when operated causes the dragon to appear to be emitting fire-like light flashes and to at the same time produce roaring sounds, of prior art interest is the Marx U.S. Pat. No. 2,055,847. This patent discloses a toy weapon that includes sparking and siren mechanisms which when the trigger is pulled, emits sparks from the muzzle of the weapon and at the same time generates a siren sound.

Of further prior art interest is the Kuo U.S. Pat. No. 4,843,336 which discloses a pistol that, when actuated, emits flashes of light as well as loud sounds. Also producing light flashes and loud sounds is the gun disclosed in the Kuo U.S. Pat. No. 5,059,150, the sounds being stored in an integrated circuit chip.

In the toy machine gun disclosed in the Palmer U.S. Pat. No. 3,570,176, the gun which includes a phonograph record, an amplifier and a loud speaker, produces the actual sound of machine gun fire synchronized with light flashes from a bulb to simulate real fire.

As pointed out in my above-identified copending applications, though toy pistols are popular with children, because many of them have the appearance of real weapons, they are now in public disfavor and in some states they are banned. In the present invention, the toy pistol is concealed in a dragon figure and therefore its actual appearance is of no consequence.

SUMMARY OF INVENTION

The main object of this invention is to provide a pistol and toy dragon figure assembly in which a pistol concealed in the figure is operable to cause the dragon to breath fire and to emit roaring sounds, and thereby simulate the activity of a real dragon.

A significant advantage of an assembly in accordance with the invention is that it may include a pistol of any design, even one that is a replica of a real weapon, for the pistol is concealed by the figure and its appearance is never visible when the figure is being held in the hand of a player.

More specifically, an object of the invention is to provide an assembly of the above type in which the pistol has housed therein an electronic unit which, when actuated, produces light flashes that are projected from the muzzle of the pistol to simulate fire, the unit also electronically producing roaring sounds.

Briefly stated, these objects are attained by a pistol and toy dragon figure assembly in which a pistol concealed in the figure is operable to cause the dragon to appear to be breathing fire and to be emitting roaring sounds. The pistol includes a barrel and a hand grip provided with a trigger. Housed in the pistol is a battery-operated electronic unit which is switched on when the trigger is pulled, the unit having a flashing light generator optically coupled to the barrel and an integrated circuit in which roaring sounds are digitally stored and converted to analog signals which are fed to a miniature speaker.

The body of the dragon has an open cavity therein to receive the pistol, the barrel of which is socketed in the head of the dragon in line with its open jaws. When a player grasps the hand grip of the pistol, he then appears to be holding the dragon, and when the player pulls the trigger, red light flashes simulating fire are then emitted from the jaws of the dragon, the fire being accompanied by roaring sounds.

BRIEF DESCRIPTION OF DRAWINGS

For a better understanding of the invention, as well as further features thereof, reference is made to the detailed description thereof to be read in connection with the annexed drawings wherein.

DESCRIPTION OF INVENTION

Figure 1:
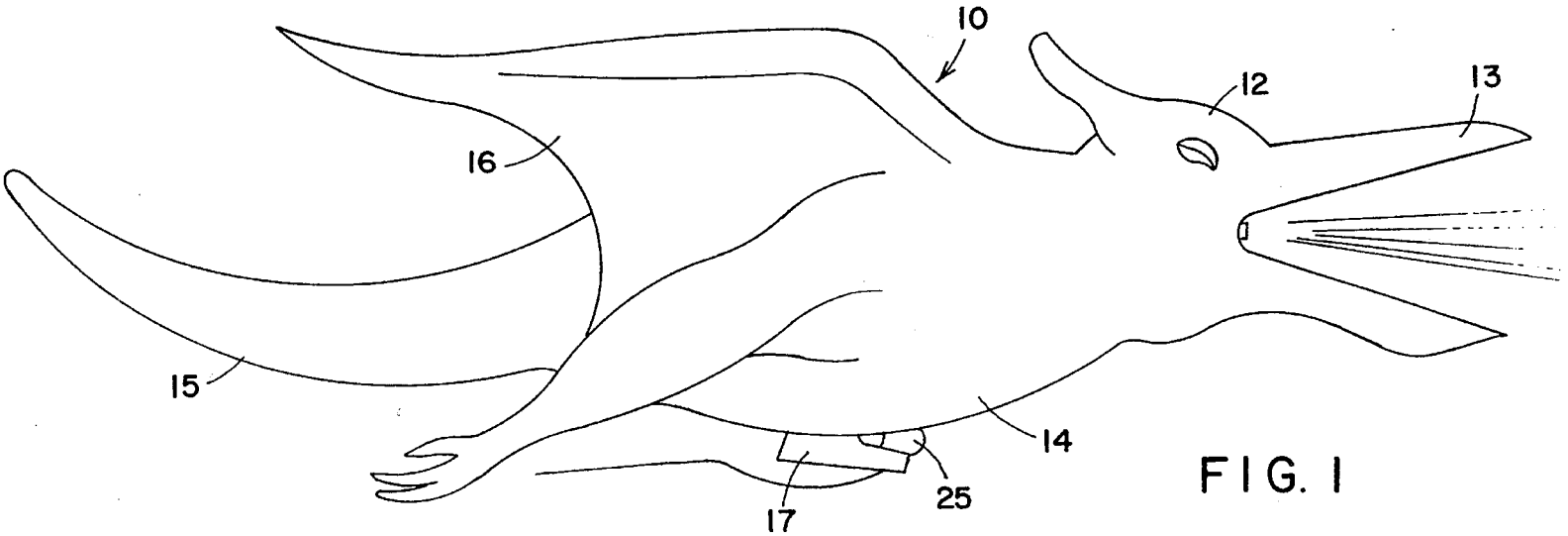
FIG. 1 is a perspective view of a pistol and dragon figure assembly in accordance with the invention.
Figure 2:
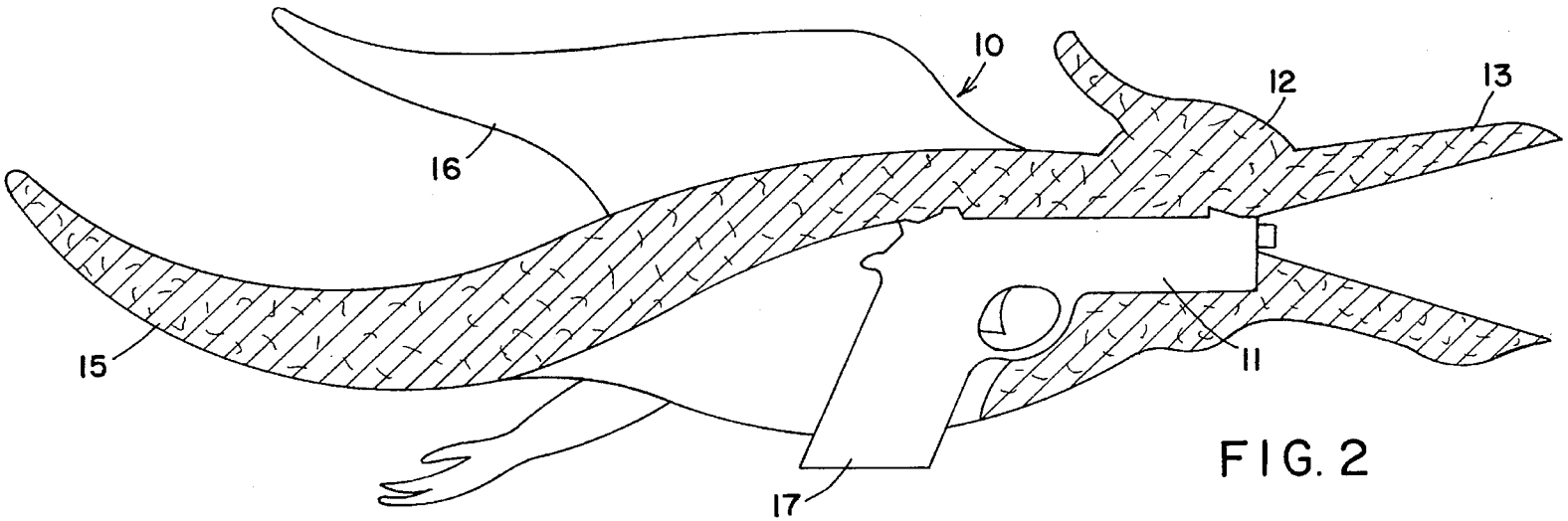
FIG. 2 is a sectional view of the pistol concealed within the figure.
Figure 3:
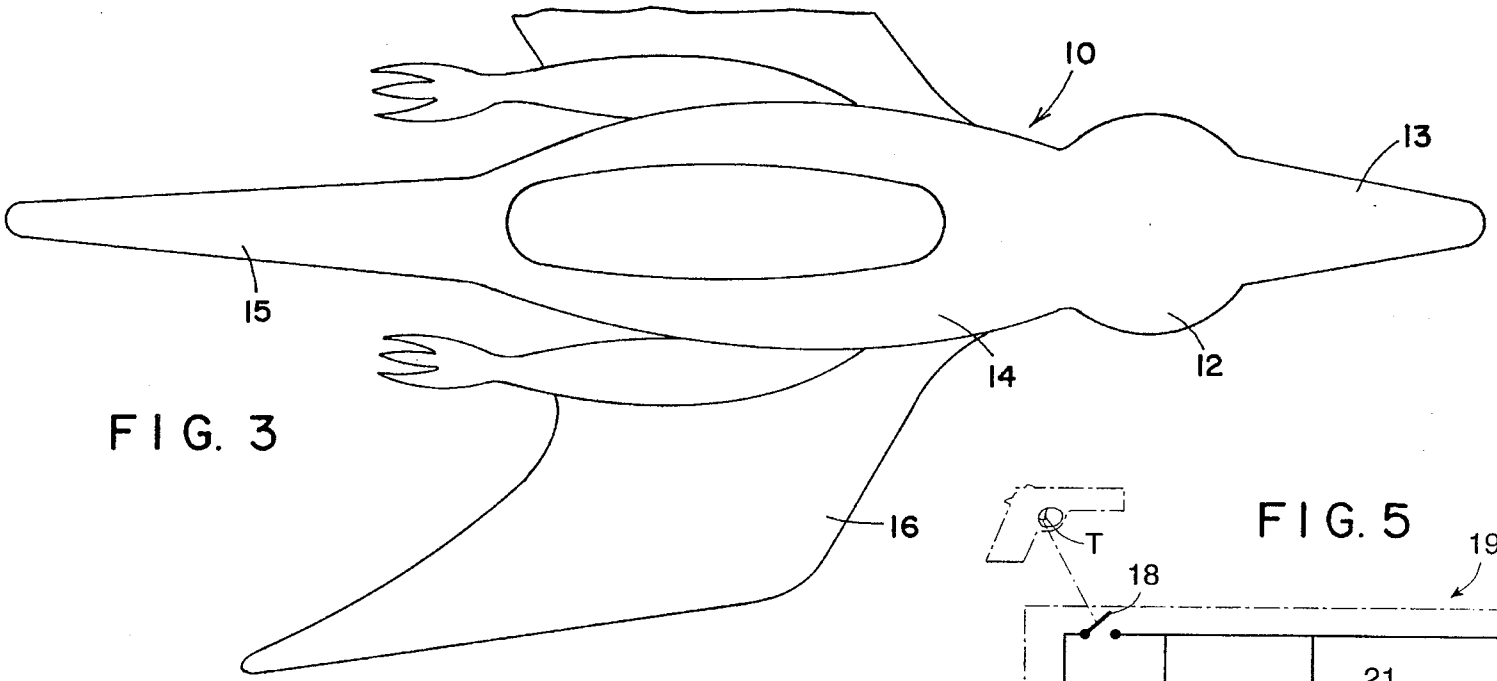
FIG. 3 is an underside view of the figure.

FIGS. 1 to 3 illustrate a pistol and dragon figure assembly in accordance with one preferred embodiment of the invention.

The dragon is generally designated by reference numeral 10 and the pistol by reference numeral 11.

Dragon 10 has a massive head 12, open jaws 13 projecting therefrom and an elongated body 14 running from the head and merging with an elongated reptilian tail 15. The dragon also has massive wings 16 hinged to its body. A dragon is a fanciful figure and as pointed out previously, the form this beast takes depends on the imagination of its creator.

The dragon figure is a soft plush construction with a plush outer skin and an interior stuffing of cotton batting or flexible foam. Hence the dragon may be held and manipulated like any conventional plush animal figure.

Figure 5:
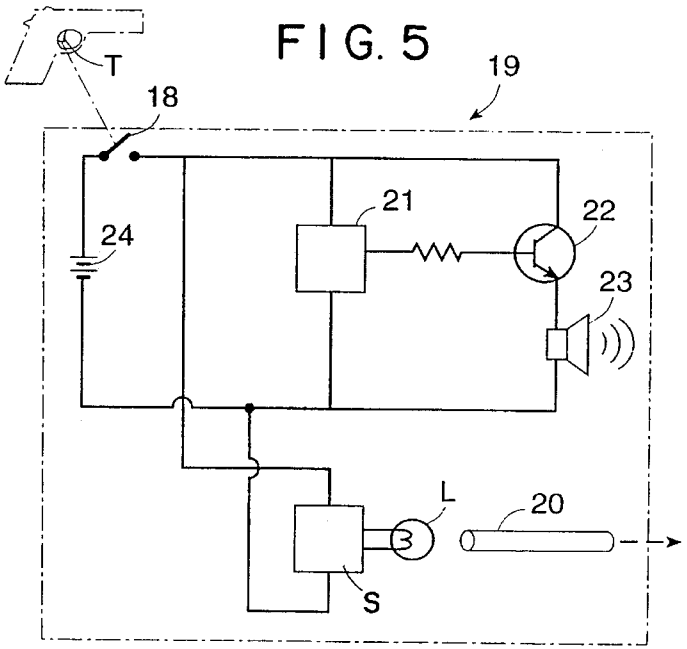
FIG. 5 is a schematic circuit diagram of the electronic unit housed in the pistol.
Figure 4:
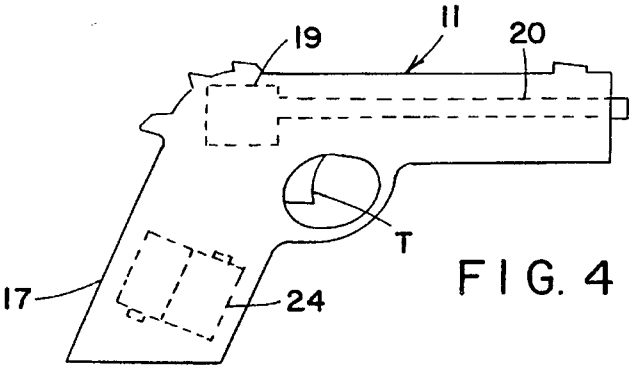
FIG. 4 is a separate view of the pistol.

As shown separately in FIGS. 4 and 5, pistol 11 includes a hand grip 17 provided with a trigger T which when pulled by a finger of the hand grasping the grip, then closes a normally-open switch 18 to actuate an electronic light and sound producing unit 19 housed in the pistol. The electronic unit includes a strobe light generator S which when switched on, then energizes a strobe light L which intermittently emits brief flashes of red or orange light.

The strobe light L by unit 19 is placed at the rear of the barrel 20 of the pistol so that the red light flashes coming out the muzzle of the barrel simulate dragon fire.

Also included in electronic unit 19 is an integrated circuit chip 21 provided with a ROM in which is digitally stored roaring sounds. When this circuit is actuated, the digitally stored roaring sounds are converted in a D to A converter to analog signals which are amplified in a transistor 22 and applied to a miniature loud speaker 23 which reproduces the sounds. Speaker is preferably located in the grip of the pistol and its output is heard through a slotted grill in the pistol grip.

The electronics unit 19 is powered by a battery 24 housed within the pistol, the battery being connected through trigger switch 18 to the integrated circuit 21 and the strobe generator S. Hence when the trigger is pulled, both light flashes simulating a dragon's fiery breath and roaring sounds simulating a dragon's roar are concurrently produced to lend credibility to the dragon figure.

As shown in FIG. 2, pistol 11 is concealed in an internal cavity in the dragon body with its barrel socketed in the head of the figure so that the muzzle of the barrel is then in line with the open jaws 13. As shown in FIG. 3, the cavity is open at the underside of the body to provide access to the pistol.

As shown in FIG. 1, a player extending his arm through the cavity grasps grip 17 with the fingers 25 of his hand so that the player then appears to be holding the dragon which he can point in any direction. When the player then pulls the trigger with a finger of his hand, the dragon figure then appears to be breathing fire, this being simulated by the red light flashes coming out of jaws of the dragon. At the same time the dragon emits roaring sounds.

While there has been shown a preferred embodiment of a pistol and toy dragon figure assembly in accordance with the invention, it will be appreciated that many changes may be made therein without departing from the spirit of the invention. Thus instead of electrically producing light flashes to create a fiery breath, use may be made for the same purpose of a sparking wheel mechanically actuated by the trigger of the pistol.

I claim:

1. A pistol and dragon figure assembly comprising:

A. a dragon figure having a head provided with open jaws, a body joined to the head having an internal cavity communicating with the head, the cavity being open at an underside of the body; and B. a pistol including means to produce when a trigger is actuated light flashes and roaring sounds, said pistol being concealed in the cavity of the figure and having a barrel whose front end is socketed in the head and is provided with a muzzle in alignment with the open jaws, said pistol having a hand grip provided with a trigger which when the grip is grasped by the fingers of a player's hand extended into the cavity, the figure then appears to be held by the player, and when the player pulls the trigger with a finger of his hand, light flashes are then emitted by said means from the open jaws accompanied by roaring sounds to simulate a live dragon.

2. An assembly as set forth in claim 1, in which the dragon figure is a soft, stuffed, figure.

3. An assembly as set forth in claim 2, in which the dragon figure is provided with wings hinged to its body and a reptilian tail extending from the body.

4. An assembly as set forth in claim 1, in which the pistol has housed therein a battery-powered electronic unit which is switched on when the trigger is pulled to produce said light flashes and said roaring sounds.

5. An assembly as set forth in claim 4, in which said unit includes a strobe light generator which is coupled to the barrel of the pistol to produce said light flashes.

6. An assembly as set forth in claim 5 in which the light flashes are red to simulate fire.

* * * * *